US010292536B2

(12) United States Patent
Hartdorn

(10) Patent No.: US 10,292,536 B2
(45) Date of Patent: May 21, 2019

(54) CHILD BATHING APPARATUS AND RELATED METHODS

(71) Applicant: Jeffrey Laurence Hartdorn, New Smyrna Beach, FL (US)

(72) Inventor: Jeffrey Laurence Hartdorn, New Smyrna Beach, FL (US)

( * ) Notice: Subject to any disclaimer, the term of this patent is extended or adjusted under 35 U.S.C. 154(b) by 117 days.

(21) Appl. No.: 14/938,125

(22) Filed: Nov. 11, 2015

(65) Prior Publication Data

US 2016/0198908 A1 Jul. 14, 2016

(51) Int. Cl.
*A47K 3/024* (2006.01)
*A47K 10/48* (2006.01)

(52) U.S. Cl.
CPC ..... *A47K 3/024* (2013.01); *A47K 10/48* (2013.01)

(58) Field of Classification Search
CPC ..... A47K 3/003; A47K 3/024; A47K 3/034; A47K 3/064; A47K 3/074; A47K 3/127; A47K 3/125; A47K 3/022; A61H 33/60; A61H 33/6031; A61H 35/00; E03C 1/044; E03C 1/052; E03C 1/055; E03D 9/08
USPC ... 4/445–446, 525, 541.1–541.6, 568, 572.1, 4/576.1–577.1, 594, 621, 667, 655; 119/673–676, 668; 5/655
See application file for complete search history.

(56) References Cited

U.S. PATENT DOCUMENTS 1,693,391 A 11/1928 Kennedy et al.
2,812,518 A * 11/1957 McGraw O'Brien ..... A47K 3/034 4/539
3,295,146 A * 1/1967 Martin ..... A47K 3/125 4/575.1
3,302,215 A * 2/1967 Clothier ..... A47K 3/024 4/420.4
3,808,608 A 5/1974 Caplan
4,068,326 A * 1/1978 Deschler ..... A47K 3/06 4/534
4,216,552 A 8/1980 Gurolnick
4,218,013 A * 8/1980 Davison ..... B05B 7/12 137/889
4,340,980 A 7/1982 Fushimi et al.
(Continued)

FOREIGN PATENT DOCUMENTS

CN 202128376 2/2012
CN 102631160 8/2012
(Continued)

*Primary Examiner* — David P Angwin
*Assistant Examiner* — Nicholas A Ros
(74) *Attorney, Agent, or Firm* — Matthew G. McKinney; Allen, Dyer et al.

(57) ABSTRACT

A child washing apparatus includes a housing having a top, a basin within the housing, and a plurality of water jets disposed around an inside surface of the basin. In addition, the apparatus includes a water heater within the housing which is configured to supply heated water to the water jets, and an air blower is in fluid communication with an interior of the basin. A countertop is secured to the top of the housing, and having first and second arm rests secured to the countertop on opposing sides of the basin. The apparatus also includes a control module coupled to the water heater and the air blower, and a rocker switch is coupled to the first arm rest and to the control module and is configured to switch between a first position and a second position by applying pressure to the first arm rest.

12 Claims, 3 Drawing Sheets

(56) References Cited

U.S. PATENT DOCUMENTS 4,730,576 A * 3/1988 Yoshikawa ..... A01K 13/001 119/673
RE32,806 E 12/1988 Gurolnick
4,903,347 A * 2/1990 Garcia ..... E03D 9/08 4/420.4
5,033,131 A * 7/1991 Paden ..... A47K 3/034 4/568
5,067,186 A 11/1991 Ayers
5,090,067 A 2/1992 Cogdill
5,092,001 A 3/1992 Ross et al.
5,290,058 A * 3/1994 Adams ..... A61G 7/0527 108/143
5,335,855 A 8/1994 Borod
5,491,849 A * 2/1996 Colussi ..... A61H 33/0087 4/541.1
5,636,391 A 6/1997 Greene, III
5,718,011 A 2/1998 Nogues
5,720,055 A 2/1998 Krist
5,848,444 A * 12/1998 Christopherson .... A61H 33/027 4/541.6
6,161,229 A * 12/2000 Ryan ..... A61G 5/14 297/DIG. 10
6,481,029 B1 * 11/2002 Mateina ..... E03C 1/05 4/584
7,305,724 B2 12/2007 Rozental et al.
7,814,584 B2 * 10/2010 Robles ..... A47K 3/074 4/545
7,818,824 B2 10/2010 Honsa
7,856,679 B1 * 12/2010 Finell ..... A47K 3/125 297/423.11
7,979,925 B2 7/2011 Karbowski
8,966,677 B1 3/2015 Leihgeber
9,681,756 B2 * 6/2017 Smith ..... A47C 15/004
2003/0061653 A1 * 4/2003 Carlet ..... E03C 1/055 4/541.1
2007/0033730 A1 2/2007 Bean
2008/0172783 A1 * 7/2008 Smith ..... A61H 33/02 4/541.4
2011/0047692 A1 3/2011 Lee
2011/0107511 A1 5/2011 Alcala et al.
2014/0325750 A1 * 11/2014 Anyika ..... A47K 3/024 4/548

FOREIGN PATENT DOCUMENTS

CN 202960286 6/2013
CN 203207910 9/2013
CN 203828799 9/2014
DE 3428447 * 8/1983 ..... A47K 11/04
DE 3428447 * 2/1985 ..... E03D 7/00

* cited by examiner

FIG. 2
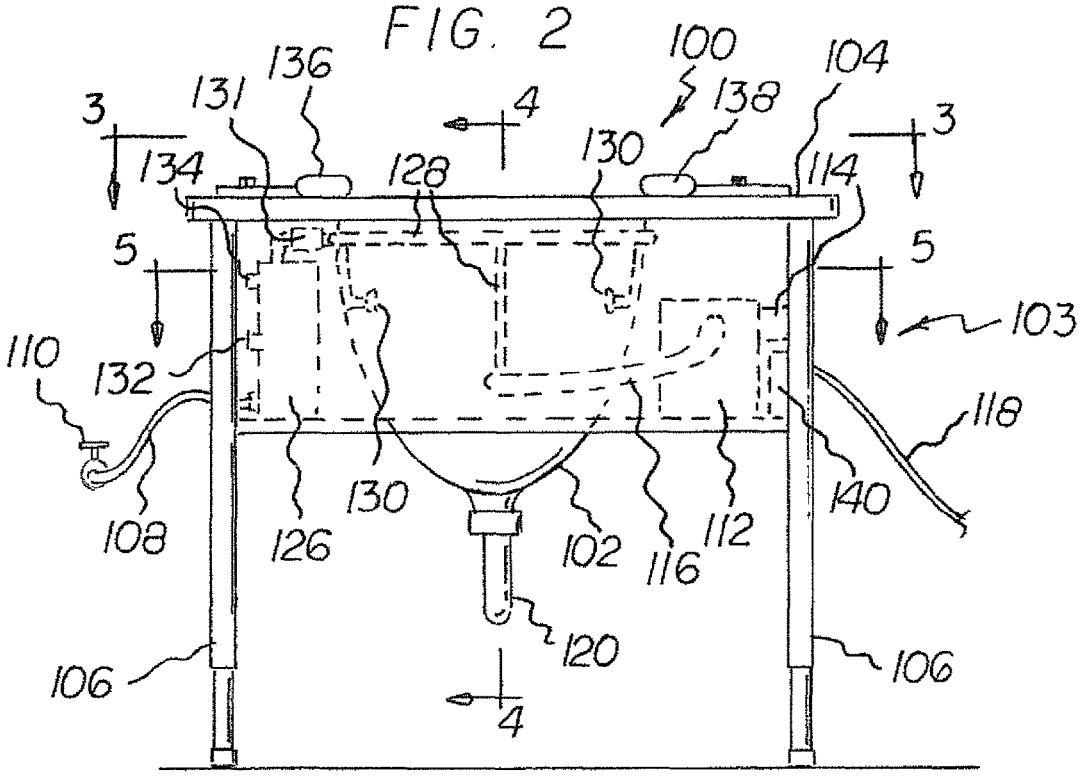
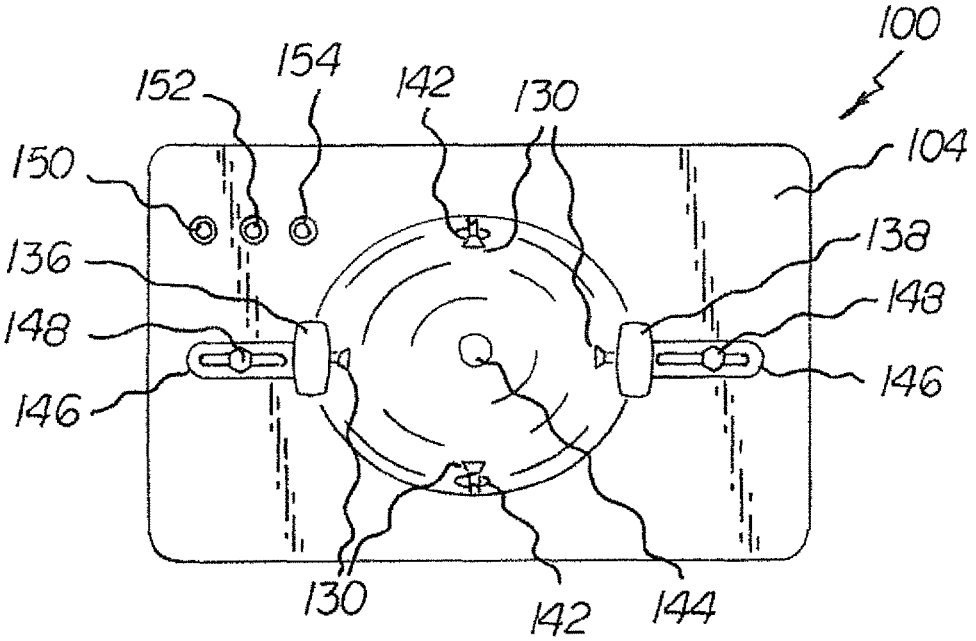
FIG. 3

FIG. 4
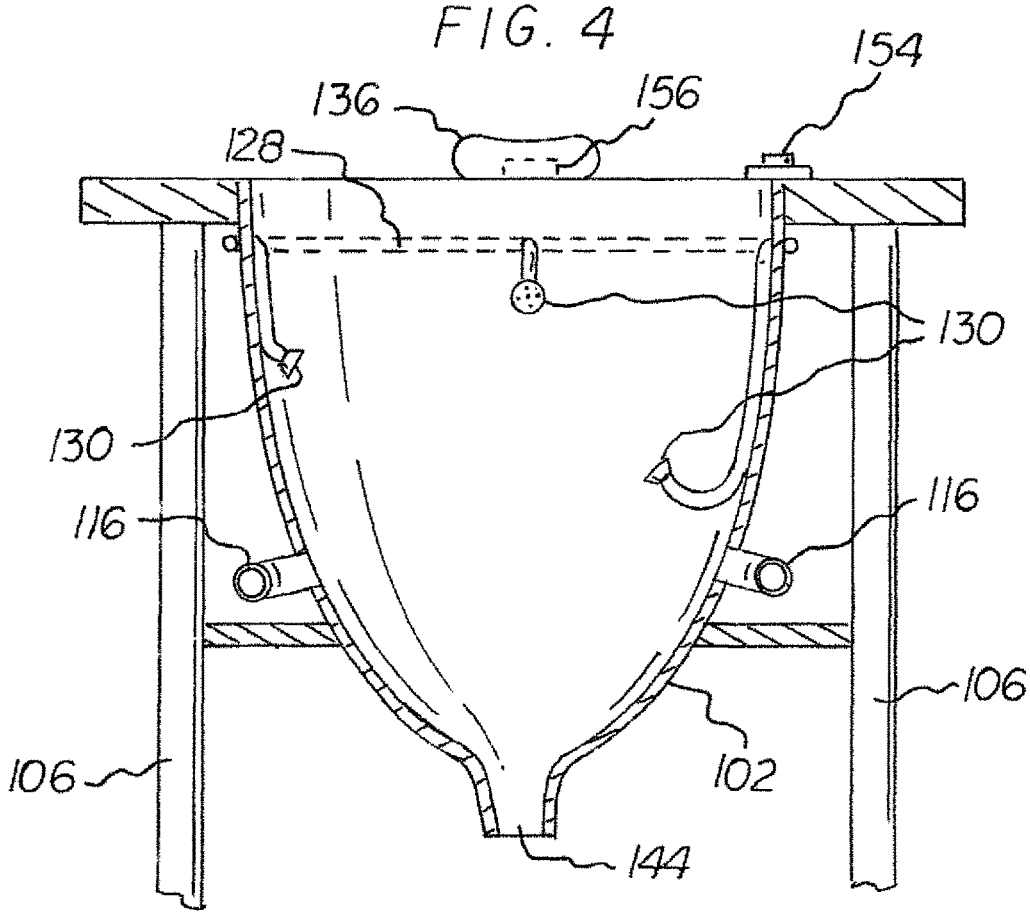
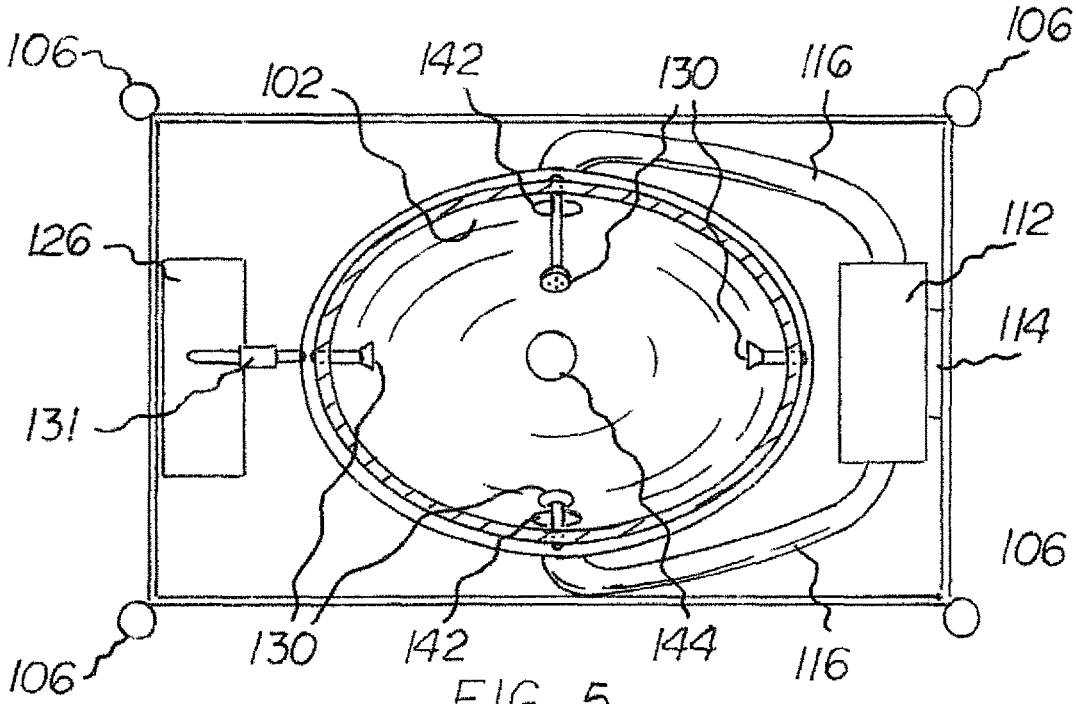
FIG. 5

CHILD BATHING APPARATUS AND RELATED METHODS

FIELD

The present invention relates to the field of hygiene, and, more particularly, to a child bathing apparatus and related methods.

BACKGROUND

Children under two years of age typically soil their diapers six to twelve times each day. Changing a soiled diaper includes placing the child on a flat surface, removing the diaper, and wiping the child clean, which requires the child to be temporarily released from the grasp of the caregiver. Wiping a baby is time consuming, messy, malodorous, leaves residue and tends to inflame and aggravate diaper rash. The cost of baby wipes in the first two years of an child's life is estimated to be approximately $900. Diaper rash, due to chafing and friction, may affect the entire diaper area.

There is a need in the art for an expeditious, pleasant, more hygienic way to clean and dry a messy child than existing approaches. There is also a need to reduce the cost associated with using large numbers of baby wipes when changing a diaper. In addition, there is a need for a system and method where the caregiver is not required to release the child when cleaning its diaper area.

The existing approaches fail to quickly and easily clean the diaper area of a child in a safe, expeditious and hands-free manner while simultaneously providing ease and comfort for both the caregiver and the child.

SUMMARY

In view of the foregoing background, it is therefore an object of the present invention to provide a quick, safe and effective apparatus and method of cleaning a diaper area of a child.

This and other objects, features, and advantages in accordance with the present invention are provided by a child washing apparatus. The child washing apparatus includes a housing having a top, a basin within the housing, and a plurality of water jets disposed around an inside surface of the basin. In addition, the apparatus includes a water heater within the housing which is configured to supply heated water to the water jets, and an air blower is in fluid communication with an interior of the basin. A countertop is secured to the top of the housing, and having first and second arm rests secured to the countertop on opposing sides of the basin. The apparatus also includes a control module coupled to the water heater and the air blower, and a rocker switch is coupled to the first arm rest and to the control module and is configured to switch between a first position and a second position by applying pressure to the first arm rest.

BRIEF DESCRIPTION OF THE DRAWINGS

FIG. 2 is a front view of the child bathing apparatus along the line 2-2 of FIG. 1;

FIG. 3 is a top view of the child bathing apparatus taken along the line 3-3 of FIG. 2;

FIG. 4 is a sectional view of the child bathing apparatus taken along the line 4-4 of FIG. 2; and FIG. 5 is sectional view of the child bathing apparatus taken along the line 5-5 of FIG. 2.

DETAILED DESCRIPTION

Figure 1:
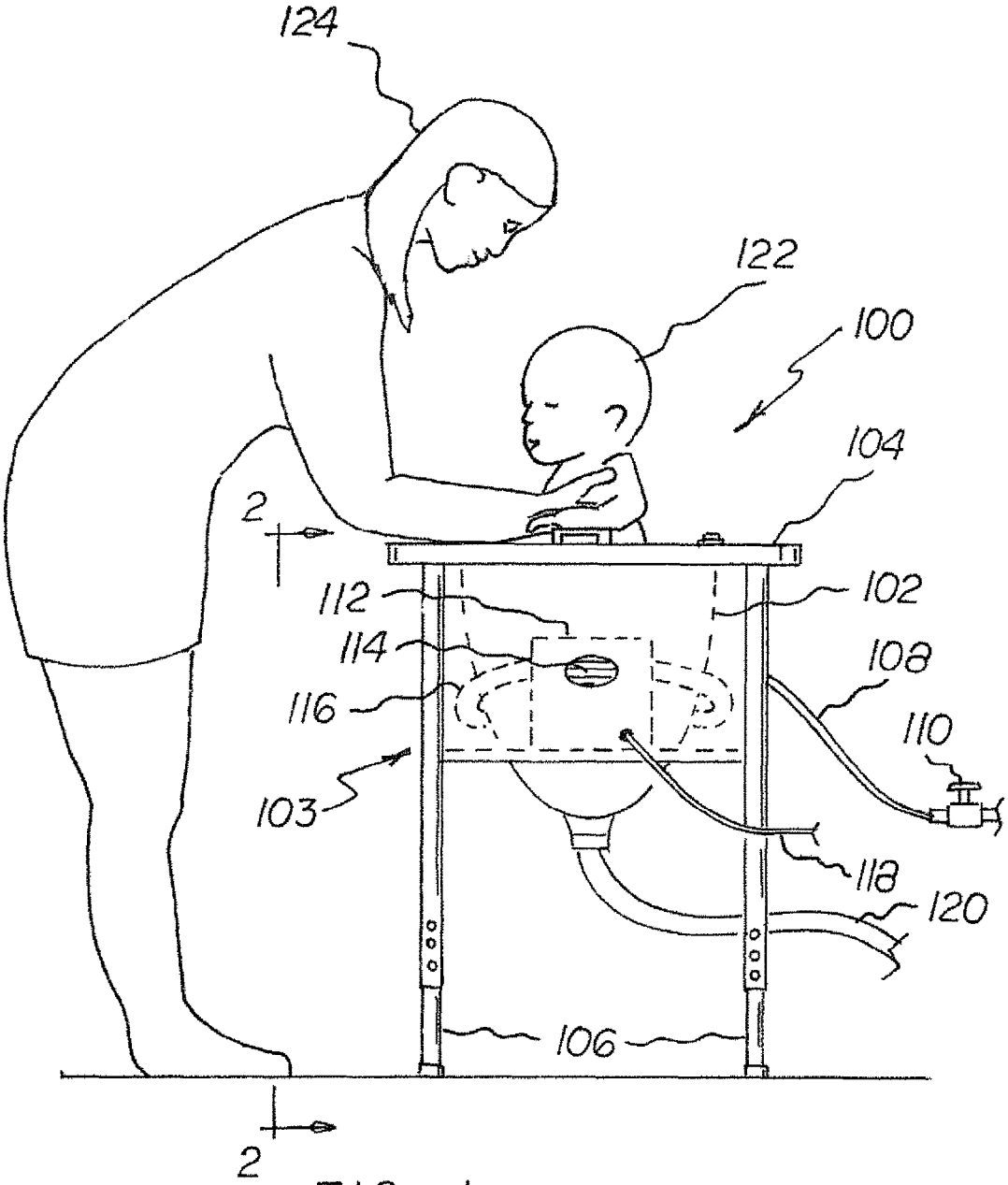
FIG. 1 is a right side elevational view of a child bathing apparatus in accordance with an embodiment of the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Referring initially to FIG. 1, a free-standing apparatus 100 to facilitate the washing of the diaper area of a child 122 is illustrated. A caregiver 124 holds the child 122 under its arms and inserts a lower portion of the child into the basin 102 of the apparatus 100. The diaper and any clothing are removed before placing the child 122 into the apparatus 100. The head of the child 122 is above the apparatus 100 while just the lower portion of the child 122 is within the apparatus 100 as shown in FIG. 1.

The apparatus 100 includes a countertop 104 and four legs 106, which are used to support a housing 103 that holds the basin 102 and associated equipment (described below) of the apparatus 100. In addition, the legs 106 are adjustable to raise/lower the housing 103 (and the basin 102) to the desired height. A water supply line 108 is in fluid communication with the basin 102, where a valve 110 controls the water volume through the water supply line 108. A drain pipe 120 is connected to the bottom of the basin 102 and is used to drain the water and waste from the basin 102.

In addition, the housing 103 includes an electric air dryer 112 having a vent 114 through the housing 103. The electric air dryer 112 is powered by an electric supply line 118 that may be coupled to a standard electrical outlet, for example. An air hose 116 is connected to the air dryer 112 and is used to supply hot dry air to the basin 102 in order to dry the child.

The water supply line 108 is coupled to a water heater 126 that is used to store and heat water to the desired temperature as shown in FIG. 2. The water heater 126 is coupled to a jet supply line 128 that is in turn connected to a plurality of water jets 130. A valve 131 is used to control the water flow to the jet supply line 128 and water jets 130. A pressure switch 132 of the water heater 126 controls the heating element 134, which is used to control the temperature of the water supplied to the water jets 130.

A left hand rest 136 and a right hand rest 138 are secured to the countertop 104 of the apparatus 100 on either side of the basin 102. The left hand rest 136 is configured to operate a rocker switch (156 in FIG. 4) that is coupled to a control module 140. The control module 140 is configured to control the valve 131 and the air dryer 112 in response to the rocker switch 156 being activated. For example, the rocker switch 156 in a first position may cause the control module 140 to turn on the water flow to the water jets 130 using valve 131. When the rocker switch 156 is moved to a second position, the control module 140 may turn off the water flow and turn on the air dryer 112, for example.

Referring now to FIG. 3, a top view of the apparatus 100 illustrates the location of the water jets 130 within the basin 102. In addition, outlets 142 for the air hose 116 into the basin 102 are also shown. The left 136 and right hand rests 138 are each mounted to a respective bracket 146 that is secured to the countertop 104. Each bracket 146 includes a slot that allows a knob 148 to slide therein and is configured to adjust the lateral position of each hand rest 136 and 138 relative to the basin 102. A drain aperture 144 is located at the bottom of the basin 102 and is connected to the drain pipe 120.

In addition, the temperature of the water in water heater 126 is controlled by a surface mounted adjustable knob 150, its absolute temperature independently confirmed by flat mounted thermometer 152. Additional (liquid) compositions such as medications, soap, or perfumes, for example, may be added to the water through aperture 154 that is connected to the jet supply line 128.

The locations of the water jets 130 can be viewed in FIG. 4. In particular, the water jets 130 are located at different heights within the basin 102 and may be adjustable for both spray pattern and volume. This is in order to thoroughly wash and rinse all areas of the child 122. In addition, the angle of the water jets 130 may be varied. The air hose 116 may be connected to the apertures 142 at the front and back of the basin 102 and strategically positioned to direct hot or warm air in order to dry the child 122.

The caregiver 124 is grasping the child 122 as shown in FIG. 1, and lowering the child 112 into the basin 102. The heel portion of the hands of the caregiver 124 contacts the left hand rest 136 and the right hand rest 138 and supports the arms of the caregiver 124. As described above, the hand rests 136 and 138 are adjusted laterally by sliding the bracket 146 and are secured by tightening the knob 148.

The left hand rest 136, for example, can be used to activate the electrical rocker switch 156 coupled thereto, which in a first position transmits an electrical signal to the control module 140. The control module 140 then may transmit an electrical signal to electrically operated valve 131 causing it to open, thereby allowing water to flow from the water heater 126 to the water jets 130 within the basin 102.

After the child 122 is adequately washed, the caregiver 124, still holding the child, shifts the pressure from the heel of her hand to the pinky finger in order to pivot the rocker switch 156 forward to the second position, thereby terminating the power to the water valve 131 and initiating power to the electrical (hot) air blower 112 by the control module 140. Warm air travels through the air hose 116 into the basin 102 through the vent apertures 142.

The apparatus 100 may use standard household 120 amp electrical supply and be connected to a ground fault circuit interrupter (GFI). Electrical power may be modified by the control module 140 to increase safety of operation. Water may be provided to the apparatus 100 using standard household plumbing pressure using the water supply line 108 coupled to a shut-off valve of a standard toilet tank (not shown), for example.

A method of using the apparatus 100 includes the child 122 being grasped and held on the sides of the chest area with its armpits supported in the space between the thumb and first finger, all four fingers supporting its back. Facing the caregiver 124, the child's bottom half is briefly lowered and suspended into the basin 102, which includes a plurality of water jets 130, then drying the bottom of the child 122 within the basin 102 by providing a flow of warm air.

The plurality of water jets 130 within the basin are directing pressurized warm water to specific areas on the body of the child 122. For example, the lower posterior diaper area of the child 122 may be receiving approximately 50 ml/sec delivered at an upward 45 degree angle, the front diaper area 30 ml/sec at a 10 degree angle, and both left and right sides of the diaper area receiving a downward spray of 20 degrees at 25 ml/sec.

Water under pressure may be provided by connecting the apparatus 100 to the household pressurized water system, which is typically at 40 to 60 psi. The child 122 is not released from the grasp of the caregiver 124 during bathing, allowing continuous comforting and eye contact. The weight of the child 122 and arms of the caregiver 123 are temporarily transferred to, and borne by the laterally adjustable hand rests 136 and 138 located on the left and right side of the basin 102, providing stability, comfort and safety.

Initiating and maintaining the flow of water to the water jets 130 is accomplished by the position of the hand of the caregiver 124 on the left hand rest 136, for example. Switching the pressure of the hand of the caregiver 124 on the left hand rest 136 activates the rocker switch 156 between a first position to activate the water jets 130 and a second position that activates the air blower 112. Thus, the duration of washing with the water jets 130 and during with the air blower 112 is in the control of the caregiver 124.

In a particular embodiment, the water jets 130 are mounted on semi-rigid hoses and capable of being manipulated by the caregiver 124 and maintaining their position in space. Soiled water exits the bottom of the apparatus 100 by gravity through a drain 144 and drain hose 120 into a suitable receptacle or wastewater system such as a toilet or sewer.

The apparatus 100 is capable of washing and drying the child 122 within a minute. In addition, the apparatus 100 is self-cleaning and reduces the large number of baby wipes typically required in caring for a child so that the apparatus is environmentally friendly.

Another advantage is that the apparatus 100 removes fecal matter and urine more thoroughly than traditional wiping and is therefore more hygienic. Another advantage is that the temperature of the water can be controlled and monitored. Another advantage is that medications or scents can be easily incorporated into the jet supply line 128.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A child washing apparatus comprising:

a housing having a top;

a basin within the housing and having an open top end and a closed bottom end;

a plurality of water jets disposed around an inside surface of the basin;

a vent aperture disposed through the inside surface of the basin;

a jet supply line coupled to the plurality of water jets;

a water heater coupled to the jet supply line and configured to supply heated water to the water jets via the jet supply line;

a countertop secured to the top of the housing;

an air blower;

a separate air hose having a first end coupled to the air blower and a second end coupled to the vent aperture to provide dry air to the basin;

first and second arm rests;

first and second brackets fixed to the countertop on opposing sides of the basin, the first bracket slidingly engaging the first arm rest and the second bracket slidingly engaging the second arm rest and configured to adjust the lateral position of each of the first and second arm rests relative to the open top of the basin;

a control module coupled to the water heater and the air blower; and a rocker switch coupled to the first arm rest and to the control module and configured to switch between a first position and a second position by applying pressure to the first arm rest.

2. The child washing apparatus of claim 1, further comprising:

a drain disposed proximate to the closed bottom end of the basin; and a drain hose coupled to the drain.

3. The child washing apparatus of claim 1, further comprising a semi-rigid hose coupled to each of the plurality of water jets and configured to be manipulated to maintain a desired position.

4. The child washing apparatus of claim 1, wherein the air blower is coupled to an electrical power supply.

5. The child washing apparatus of claim 1, wherein the water supply line is configured to be coupled to a shut-off valve of a toilet tank.

6. The child washing apparatus of claim 1, wherein a first water jet of the plurality of water jets is configured to supply approximately 50 ml/sec at an upward 45 degree angle, a second water jet is configured to supply approximately 30 ml/sec at a downward 10 degree angle, and a pair of water jets are configured to supply approximately 25 ml/sec at a downward 20 degree angle.

7. The child washing apparatus of claim 1, wherein the rocker switch is in the first position when pressure is applied to a first end of the first arm rest, and the rocker switch is in the second position when pressure is applied to the second end of the first arm rest.

8. The child washing apparatus of claim 7, further comprising a water valve interposed between the water heater and the plurality of water jets, wherein the control module opens the water valve when the rocker switch is in the first position and closes the valve when the rocker position is in the second position.

9. The child washing apparatus of claim 8, wherein the control module turns on the air blower when the rocker switch is in the second position and turns off the air blower when the rocker switch is the first position.

10. The child washing apparatus of claim 1, further comprising a water supply line coupled to the plurality of water jets.

11. The child washing apparatus of claim 10, further comprising an aperture in the countertop and coupled to the water supply line and configured to introduce a liquid composition into the plurality of water jets.

12. The child washing apparatus of claim 11, wherein the liquid composition comprises soap, medicine, perfumes, or any combination thereof.

* * * * *